US005597989A

United States Patent [19]

Nishio

[11] Patent Number: 5,597,989

[45] Date of Patent: Jan. 28, 1997

[54] SWITCH ASSEMBLY INCLUDING CAM OPERATED PIVOTED CONTACT

[75] Inventor: Minoru Nishio, Aichi, Japan

[73] Assignee: Kabushiki Kaisha Tokai Rika Denki Seisakusho, Aichi, Japan

[21] Appl. No.: 613,536

[22] Filed: Mar. 11, 1996

Related U.S. Application Data

[63] Continuation of Ser. No. 321,927, Oct. 12, 1994, abandoned.

[30] Foreign Application Priority Data

Oct. 14, 1993 [JP] Japan ..... 5-055569 U

[51] Int. Cl.[6] ..... H01H 19/00; H01H 5/08

[52] U.S. Cl. ..... 200/6 R; 200/6 B; 200/437

[58] Field of Search ..... 200/5 R–5 F, 6 R, 200/6 A, 6 B, 6 BA, 6 BB, 6 C, 17 R, 18, 402, 406, 433, 436, 437, 438, 457–459, 461

[56] References Cited

U.S. PATENT DOCUMENTS

| | | | |
|---|---|---|---|
| 2,248,362 | 7/1941 | Krieger | 200/6 B |
| 3,196,220 | 7/1965 | Brown | 200/6 R |
| 3,348,010 | 10/1967 | Johnson | 200/430 |
| 3,439,138 | 4/1969 | Braun | 200/437 |
| 3,482,067 | 12/1969 | Sanford | 200/6 BB X |
| 3,598,943 | 8/1971 | Barrett | 200/437 |
| 4,408,105 | 10/1983 | Tanaka | 200/6 BA X |
| 4,814,554 | 3/1989 | Magiera | 200/6 R |

*Primary Examiner*—J. R. Scott

*Attorney, Agent, or Firm*—Finnegan, Henderson, Farabow, Garrett & Dunner, L.L.P.

[57] ABSTRACT

A switch device includes a stationary contact, a movable contact member having a pair of arms on both sides through which the movable contact piece is swung so as to be brought selectively into or out of engagement with the stationary contact. The movable contact piece is sloping near the dead point thereof on a surface to be pushed. The device both includes an operating knob having a pusher adapted to apply a force the surface to be pushed, the pusher swinging the movable contact piece when the pusher, and sliding on the surface to be pushed, goes over the dead point, wherein the center of swing of the movable contact piece is substantially equal in level to the dead point on the surface which is to be pushed.

3 Claims, 5 Drawing Sheets

SWITCH ASSEMBLY INCLUDING CAM OPERATED PIVOTED CONTACT

This application is a continuation, of application Ser. No. 08/321,927 filed Oct. 12, 1994, now abandoned.

BACKGROUND OF THE INVENTION

1. Field of the Invention

This invention relates to a switch device of the type where its operating knob is swung to trip the movable contact piece.

2. Related Art

The arrangement of a conventional switch device of this type is as shown in FIGS. 6 through 8.

As shown in FIG. 6, stationary contacts 2*a* and 2*b*, and an L-shaped common contact 3 are provided in a casing 1. A movable contact piece 4 is placed on the front end of the common contact 3, in such a manner that it is swingable about a center of swing 4*a* located on the common contact 3. In addition, an operating knob 5 is mounted on the casing 1 in such a manner that it is swingable about a shaft 5*a*. The operating knob 5 has a pusher 6 which is adapted to push the surface of the movable contact piece 4. The movable contact 4 is to be pushed by its upper surface 4*b*. The pusher 6 is urged towards the movable contact piece 4 by a compression coil spring 6*a*.

In the switch device thus constructed, when the operating knob 5 is at the neutral position, the movable contact piece 4 is held downward towards the right as indicated by the solid line in FIG. 6; that is, it is in contact with the stationary contact 2*a*. Under this condition, the operating knob 5 is swung in the direction of the arrow A, the pusher 6 is swung in the same direction, and at the same time the end portion of the pusher 6 is slid on the upper surface 4 of the movable contact piece 4*b*.

As shown in FIGS. 7 and 8, the point of intersection of the upper surface 4*b* and the perpendicular α drown from the center of swing 4*a* of the movable contact piece 4 to the upper surface 4*b* is the dead point 7. Hence, as indicated by the one-dot chain line in those figures, the movable contact piece 4 is not allowed to swing until the depression point (contact point) of the pusher against the upper surface 4*b* of the movable contact piece reaches the dead point 7; that is, the movable contact piece 4 is swung in the direction of the arrow C when the depression point reaches the dead point 7. The movable contact piece 4 is swung with the movement of the pusher 6, and the swinging operation is ended when the left end portion of the movable contact piece 4 is brought into contact with the left stationary contact 2*b* as indicated by the two-dot chain line in FIG. 6. At the end of the swinging operation of the movable contact piece, the depression point of the pusher 6 against the upper surface 4*b* is indicated at 8, and the perpendicular dropped from the center of swing 4 is indicated at α'.

The above-described switch device suffers from the difficulty that, when the movable contact piece 4 is operated into and out of engagement with the stationary contact 2*a* or 2*b*, arcs may be produced between them to consume the stationary contact 2*a* or 2*b*. This is significant when the switch device required to interruption of a fault current. Thus, in order to decrease the consumption of the contacts, it is essential to shorten the period of time in which the arcs occur; i.e., to increase the opening speed of the switching contacts and this reduces consumption of the contacts.

In the above-described conventional switch device, the center of swing 4*a* is provided on the lower surface of the movable contact piece 4; that is, the distance between the center of swing 4*a* and the depression point of the pusher 6 against the movable contact piece 4 corresponds to the thickness of the movable contact 4. Hence, it is necessary for the pusher 6 to move through a stroke L for the period of time from the time instant that the movable contact piece 4 starts swinging until it ends it. The stroke L is approximately represented by the following expression (1):

$$L \approx t \times \tan\theta \tag{1}$$

where t is the distance between the center of swing 4*a* of the movable contact piece 4 and the depression point of the pusher 6 against the movable contact piece 4 (i.e., the thickness of the movable contact piece 4); and θ is the angle of swing of the movable contact piece 4).

As is apparent from the above description, the angle of swing of the pusher 6, and accordingly the angle of operation of the operating knob 5 is large, and the contact switching speed S of the operating knob 5 is slow. The contact switching speed S can be calculated according to the following equation (2):

$$S = l/\{(V/\pi d) \times (\phi/180)\} \tag{2}$$

where V is the operating speed of the operating knob 5, d is the distance between the shaft 5*a* of the operating knob 5 and the end of the pusher 6; l is the distance between the movable contact piece 4 and the stationary contact 2*b*; and ϕ is the angle of swing through which the pusher 6 swings for the period of time from the instant that the movable contact piece 4 starts swinging until it ends.

For instance in the case where V=90 mm/s, d=20 mm, and l=1.3 mm, $$\begin{aligned} S &= 1.3/\{(90/20\pi) \times (\phi/180)\} \\ &= 163.28/\phi \end{aligned} \tag{3}$$

In the above-described switch device, the stroke L of the pusher 6 is long, and the angle of swing is about two (2) degrees. Therefore, when ϕ=2 is substituted in the equation (3), the contact switching speed S is as follows:

$$\begin{aligned} S &= 163.28/2 \\ &= 81.7 \text{ (mm/s)} \end{aligned} \tag{3a}$$

SUMMARY OF THE INVENTION

In view of the foregoing, an object of the invention is to provide a switch device which is so high in contact switching speed that contacts volume are decreased in the degree of consumption.

The foregoing object of the invention has been achieved by the provision of a switch device comprising: a stationary contact; a movable contact piece having a pair of arms on both sides through which the movable contact piece is swung so as to be brought selectively into or out of engagement with the stationary contact; the movable contact piece sloping near the dead point thereof on a surface to be pushed; and an operating knob having a pusher adapted to push the surface to be pushed the pusher swinging the movable contact piece when the pusher; sliding on the surface to be pushed, goes over the dead point, wherein, the center of swing of the movable contact piece is substantially equal in level to the dead point on the surface to be pushed.

In the switch device of the invention, the movable contact piece has a pair of arms through which the movable contact piece is swingable, and which makes it possible to set the center of swing of the movable contact piece irrespective of the thickness of the movable contact. The center of the swing of the movable contact piece is substantially at the same level as the dead point of the latter, which makes it substantially unnecessary for the pusher to move in vain for the period of time from the instant that the movable contact piece starts swinging until it ends. Hence, the pusher, and the operating knob is minimized in the angle of operation (swing), and the contact switching speed is increased.

DETAILED DESCRIPTION OF THE PREFERRED EMBODIMENTS

A switch device employed as a power window switch in an automobile, which constitutes one embodiment of the invention, will be described with reference to FIGS. 1 through 5.

Figure 5:
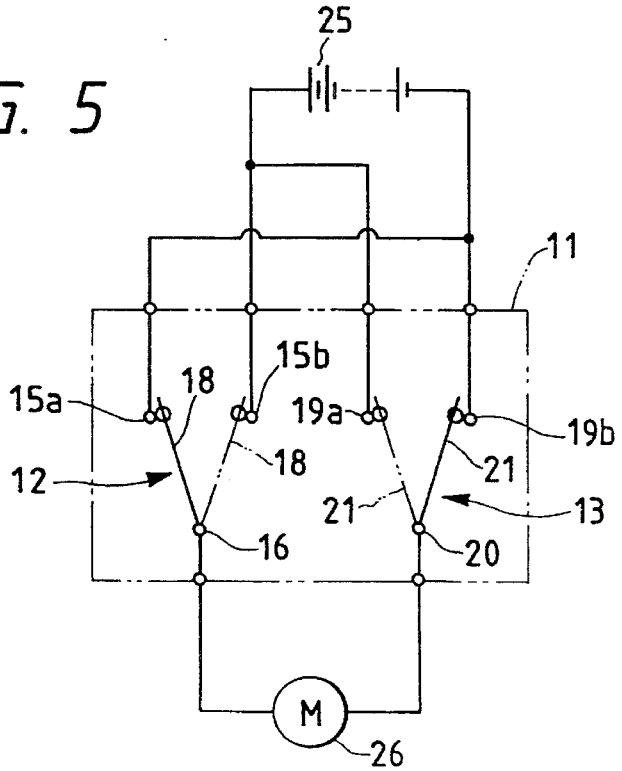
FIG. 5 is a circuit diagram showing the electrical arrangement of the switch device according to the invention.
Figure 6:
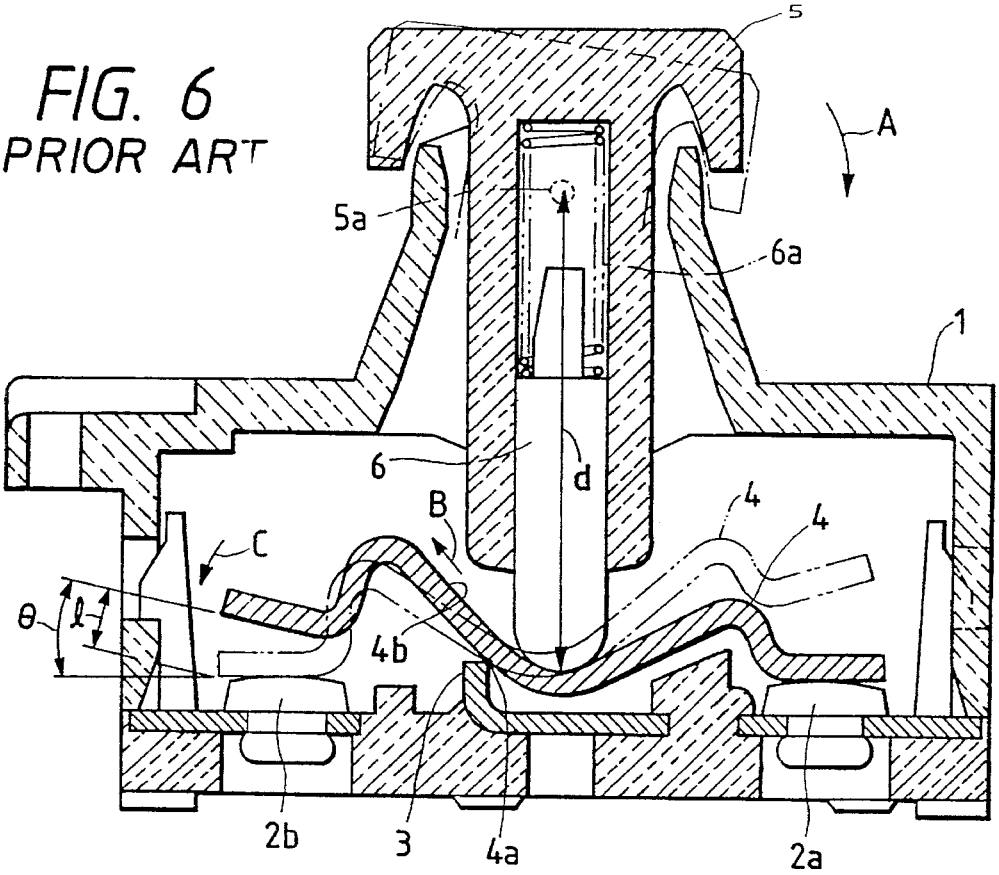
FIG. 6 PRIOR ART
FIG. 6 is a vertical sectional front view of a conventional switch device.
Figure 8:
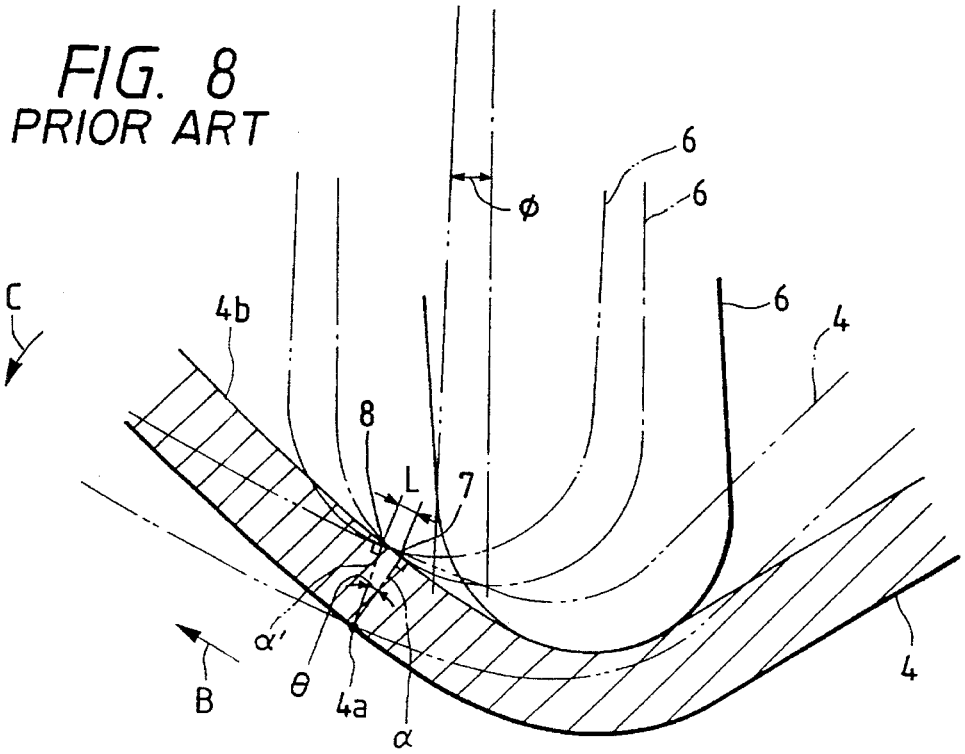
FIG. 8 PRIOR ART
FIG. 8 is an enlarged sectional front view illustrating the swinging operation of a movable contact piece in the conventional switch device.
Figure 7:
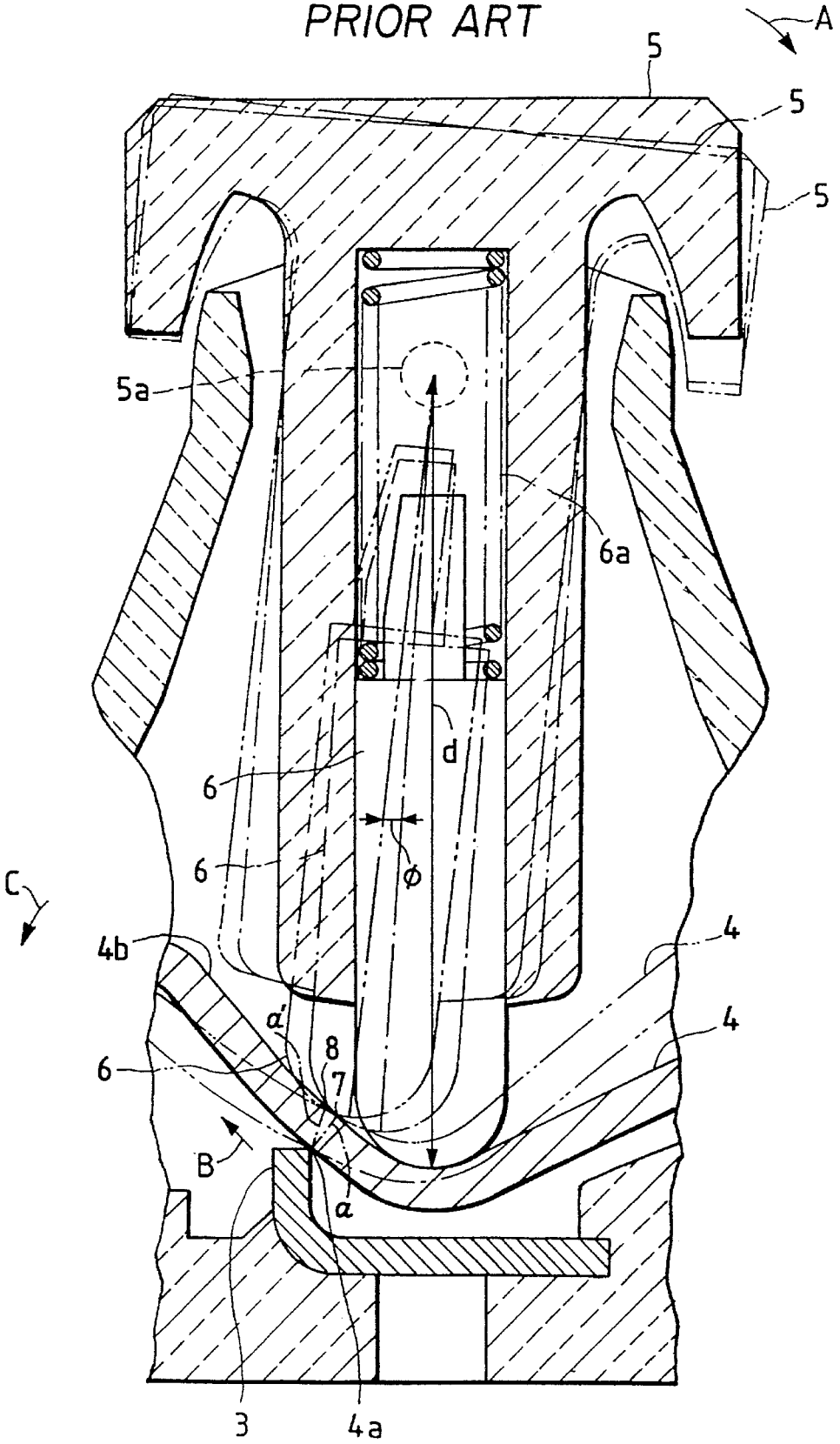
FIG. 7 PRIOR ART
FIG. 7 is an enlarged vertical sectional front view illustrating the swinging operations of an operating knob and of a pusher in the conventional switch device.

The switch device of the invention, as shown in FIG. 5, comprises: a casing 11; first and second switches 12 and 13 provided in the casing 11; an operating knob 14 (cf FIG. 1) mounted on the casing 11, for operating the switches 12 and 13. The first switch 12 is designed as follows.

Figure 1:
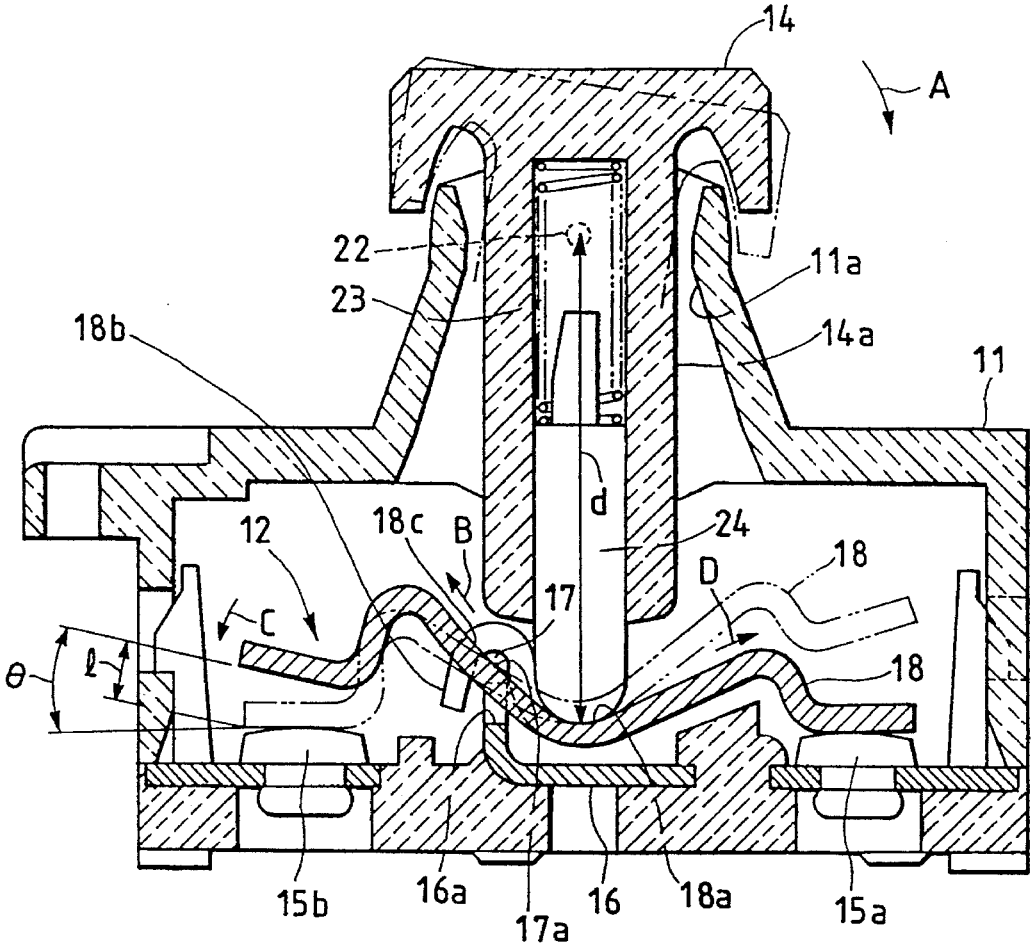
FIG. 1 is a vertical sectional front view of a switch device, which constitutes an embodiment of the invention.

As shown in FIG. 1, stationary contacts 15*a* and 15*b* are provided in the casing at the right and left ends, and a substantially L-shaped common contact 16 is provided between the right and left stationary contacts 15*a* and 15*b*. The front end portion of the common contact 16 has a cut 16*a* in the middle, and shafts 17 and 17 on both sides of the cut 16*a*. The shafts 17 are electrically connected to the common contact 16.

Figure 2:
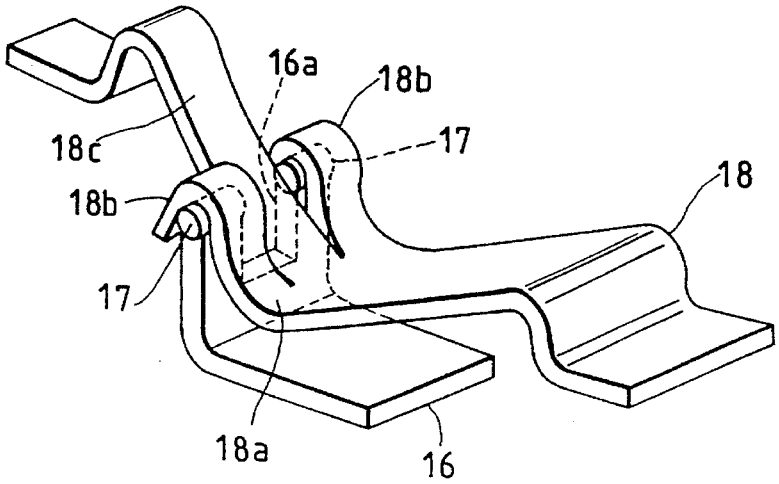
FIG. 2 is a perspective view of a movable contact piece which is supported in the switch device.
Figure 3:
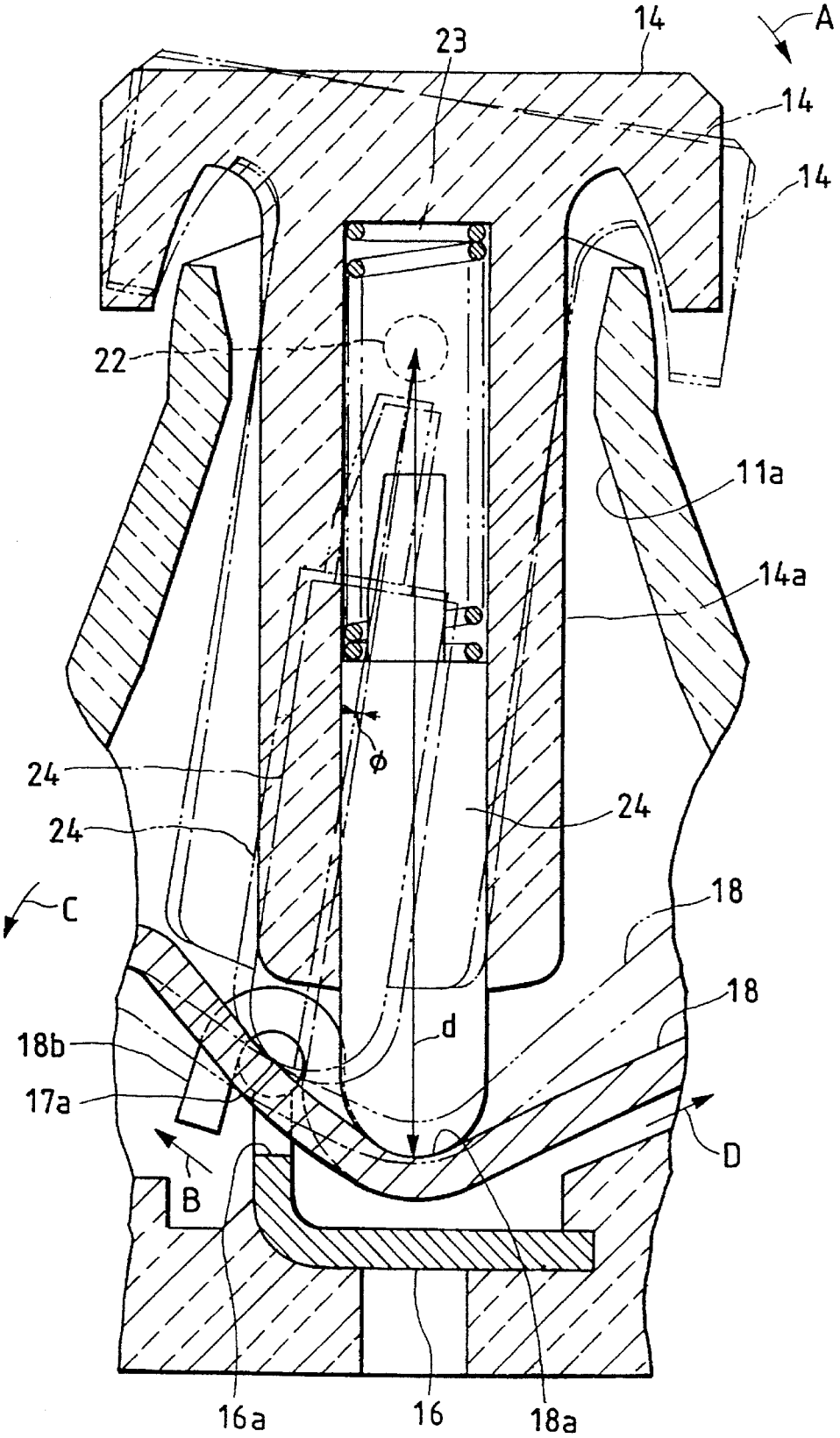
FIG. 3 is an enlarged vertical sectional front view illustrating the swinging operations of an operating knob and of a pusher in the switch device of the invention.
Figure 4:
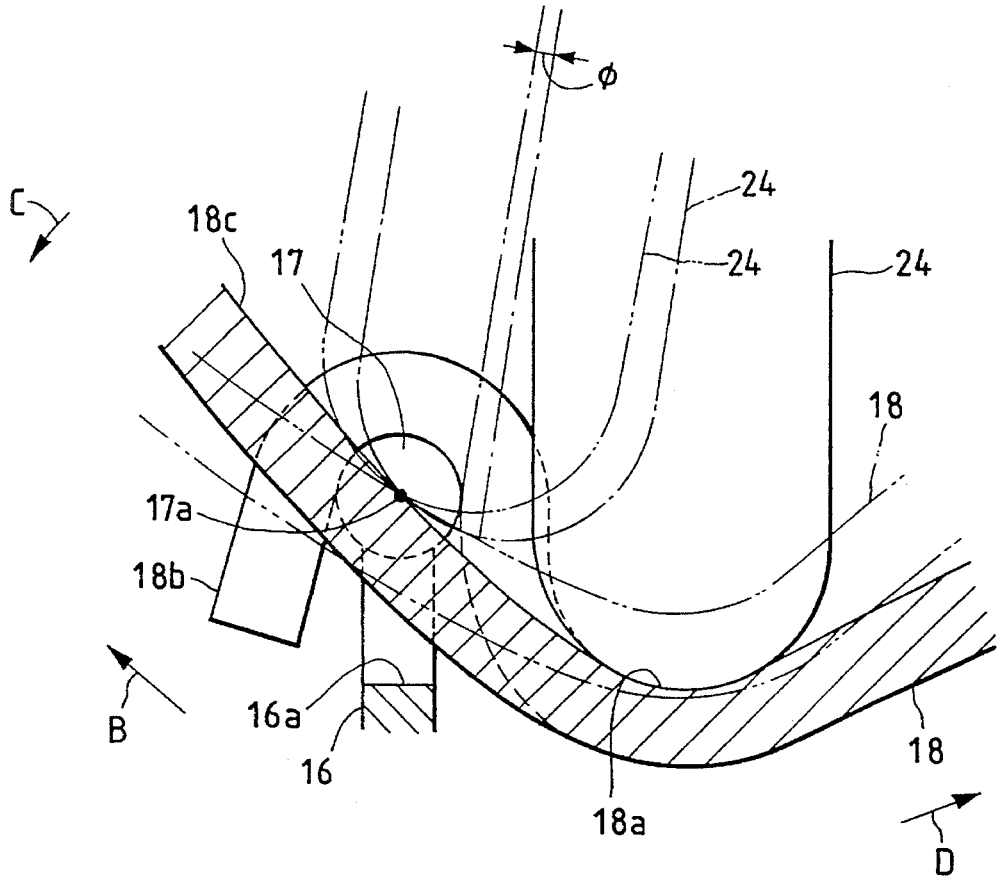
FIG. 4 is an enlarged sectional front view illustrating the swinging operation of the movable contact piece.

As shown in FIG. 1, a movable contact piece 18 is provided in the casing 11. The movable contact piece 18 is made of a metal plate 0.7 mm in thickness, and its middle portion is curved downwardly as indicated at 18*a* (hereinafter referred to as "a downwardly curved portion 18*a*", when applicable). As shown in FIG. 2, the left end portion of the movable contact piece 18, which merges with the downwardly curved portion 18*a*, is formed into a pair of arms 18*b* and 18*b* arranged on both sides thereof. The pair of arms 18*b* are swingably engaged with the pair of shafts 17 of the common contact 16, and the base portion of the movable contact piece 18 is set in the cut 16*a*. As is apparent from the above description, the movable contact piece 18 is swung while being kept in contact with the common contact 16. Normally the movable contact piece 18 is inclined downward towards the right, thus being in contact with the right stationary contact 15*a*.

The second switch 13 is substantially equal in structure to the above-described first switch 12, and therefore it will be briefly described here. The second switch 13 essentially comprises stationary contacts 19*a* and 19*b*, a common contact 20, and a movable contact 21. The second switch 13 is provided behind the first switch 12 in FIG. 1 in such a manner that it is in parallel with the latter 12. The second switch 13 is inclined downward towards the left in FIG. 1, thus being in contact with the left stationary contact 19*b*.

The operating knob 14 is a substantially T-shaped section having a vertically elongated cylindrical portion 14*a*. The operating knob 14 is mounted on the casing 11 in such a manner that it is swingable about a shaft 22. The cylindrical portion 14*a* of the operating knob 14 is inserted into the cylindrical portion 11*a* of the casing 11. On the other hand, the cylindrical portion 14*a* of the operating knob 14 accommodates a compression coil spring 23 and a pusher 24. When the operating knob 14 is at the neutral position as shown in FIG. 1, the end portion of the pusher 24 is engaged with the downwardly curved portion 18*a* of the movable contact piece 18, so that the movable contact piece 18 engages the stationary contact 15*a*. Thus, the structure of the operating knob 14 has been described.

In FIG. 5, reference numeral 25 designates a battery on the vehicle, and 26, a power window motor. As the power window motor 26 is rotated selectively in the forward direction or in the reverse direction, the power window is selectively moved upwardly or downwardly. When the operating knob 14 is at the neutral position, the end portion of the pusher 24 is engaged with the downwardly curved portion (not shown) of the movable contact piece 21, so that the movable contact piece 21 is held engaged with the stationary contact 19*b*, and the power window motor 26 is kept turned off.

The above-described switch device operates as follows: When, in FIGS. 1 and 3, the operating knob 14 is swung from the neutral position in the direction of the arrow A, the pusher 24 is swung in the same direction. The end portion of the pusher 24 slides on the upper surface 18*c* of the movable contact 18 in the direction of the arrow B while the compression coil spring is being compressed.

In this operation, the center of swing 17*a* of the movable contact piece 18 is at the same level as the upper surface 18*c* of the movable contact piece 18; that is, it coincides with the dead point of the latter 18. Hence, as indicated by the one-dot chain line in FIGS. 3 and 4, the movable contact piece 18 is not allowed to swing until the depression point of the pusher 24 against the upper surface 18*c* of the movable contact piece 18 reaches the center of swing 17*a* of the movable contact piece 18. When the depression point of the pusher 24 goes over the center of swing 17*a*, as indicated by the two-dot chain line, the movable contact piece 18 starts swinging. Thus, the contact point of the movable contact piece 18 and the pusher 24 is maintained unchanged in relative position (the center of swing 17*a*); and movable contact piece 18 swings into contact with the left stationary contact 15*b*.

When the operating knob 14 is swung in the direction of the arrow A as was described above, the end portion of the pusher 24 is slid on the upper surface of the movable contact piece 21 of the second switch 13; however, the movable contact piece 21 is not swung because the latter 21 has been inclined downward towards the left; that is, it is kept in contact with the stationary contact 19*b*.

Thus, in the first switch 12, the movable contact piece 18 is tripped over to the stationary contact 15*b* as indicated by the one-dot chain line; whereas in the second switch 13, the movable contact piece 21 is held in contact with the stationary contact 19*b* as indicated by the solid line. Hence, the power window motor 26 is energized to rotate in the forward direction, so that the power window is moved in the forward direction.

When the operating knob 14 is swung from the neutral position in the direction opposite to the direction of the arrow A in FIG. 1, the end portion of the pusher 24 is slid on the upper surface 18*c* of the movable contact piece 18 in the direction of the arrow D. However, in this case, the movable contact piece 18 is not swung because it has been inclined downward towards the left; that is, it is kept in contact with the right stationary contact 15*a*. On the other hand, in the second switch 13, the movable contact piece 21 has been inclined downward towards the left, and therefore it is pushed by the pusher 24, so that it is swung, and brought into contact with the stationary contact 19*a*.

Thus, in the first switch 12, the movable contact piece 18 is kept in contact with the stationary contact 15*a* as indicated by the solid line in FIG. 5; whereas in the second switch 13, the movable contact piece 21 is tripped over to the stationary contact 19*a* as indicated by the two-dot chain line. Hence, the power window motor 26 is energized to rotate in the reverse direction, so that the power window is moved in the backward direction.

When the operating knob 14 is released after being swung from the neutral position, the compression coil spring 23 is restored to cause the pusher 24 to slide on the movable contact piece 18 (or 21), so that the operating knob 14 is automatically returned to the neutral position. And the pusher 24 is engaged with the downwardly curved portion 18*a* of the movable contact piece 18 (or the downwardly curved portion of the movable contact piece 21), so that the operating knob 14 is held at the neutral position.

In the above-described switch device, the movable contact piece 18 has the pair of arms 18*b* and 18*b* so that it is swingable through the arms 18*b* and 18*b*, and makes it possible to set the center of swing 17*a* of the movable contact piece 1 irrespective of the thickness of the movable contact piece 18. The center of swing 17*a* of the movable contact piece 18 is substantially at the same level as the dead point of the movable contact piece 18, which makes it substantially unnecessary for the pusher 24 to move in vain for the period of time from the instant that the movable contact piece 18 starts swinging until it ends. Therefore, the pusher 24, and accordingly the operating knob 14 is minimized in the angle of operation (swing), and the contact switching speed is increased. The same may be said about the second switch.

In other words, the angle of operation $\phi$ of the operating knob 14 required for swinging the pusher 24 and the stroke L is decreased. Thus the contact switch speed S is increased. Also, the arc producing is decreased, which results in a decrease in consumption of the contacts volume. This will be proven by using arithmetic expressions below.

In the case where the fundamental conditions are equal to those of the above-described conventional switch device, the contact switching speed S of the operating knob 14 is represented by the above-described equation (3):

$$S=163.28/\phi \quad (3)$$

The angle of operation $\phi$ of the operating knob 14 is reduced to about 1.45° from 2° (which is the angle of operation in the case of the conventional switch device). When $\phi$=1.45° is substituted in the equation (3), then the contact switching speed S is as follows:

$$\begin{aligned} S &= 163.28/1.45 \\ &= 113\ (\text{mm/s}) \end{aligned} \quad (3b)$$

On the other hand, in the conventional switch device, S=81.7. Therefore, in the switch device of the invention, the contact switching speed is increased as much as 38% (113/81.7 =1.38), when compared with that in the conventional switch device.

In the above-described embodiment, the operating knob 14 is swingably provided, and the pusher 24 is swung along the movable contact piece 18 (21) as the operating knob 14 swings; however, the invention is not limited thereto or thereby. That is, the switch device may be so modified that the operating knob 14 is slid horizontally, and the pusher 24 is moved horizontally along the movable contact piece 18 (21) as the operating knob 14 slides horizontally.

Furthermore, in the above-described embodiment, the movable contact piece 18 is mounted on the shafts 17 of the common contact 16, so that the movable contact piece 18 is electrically connected to the common contact 16; however, the electrical connection of the movable contact piece 18 to the common contact 16 may be changed for instance as follows: A pair of shafts are formed on the casing 11, the pair of arms 18*b* and 18*b* are swingably engaged with the pair of shafts thus formed, and the common contact 16 is connected through a lead wire to the movable contact piece 18. The same can be said about the movable contact piece 21.

While the invention has been described with reference to the switch assembly which is employed as a power window switch in the automobile it goes without saying that the technical concept of the invention can widely applied to other switch devices.

As is apparent from the above description, in the switch device of the invention, the movable contact piece has the pair of arms through which the movable contact piece is swung, which makes it possible to set the center of swing of the movable contact piece irrespective of the thickness of the latter. The center of swing of the movable contact piece is substantially at the same level as the dead point of the latter, which makes it substantially unnecessary for the pusher to move in vain for the period of time from the time that the movable contact piece starts swinging until it ends. Hence, the pusher, and accordingly the operating knob is minimized in the angle of operation (swing), and therefore the contact switching speed is increased as much. Also, the arc producing is decreased, and the consumption of the contacts volume is decreased.

What is claimed is:

1. A switch device comprising:

a switch casing including a top portion having an opening, a bottom portion, and a hollow interior;

a first stationary contact supported by said bottom portion within said hollow interior of said switch casing;

a second stationary contact supported by said bottom portion within said hollow interior of said switch casing in spaced relation to said first stationary contact;

an L-shaped common contact having a first part supported by said casing bottom portion and an upstanding second part terminating in laterally spaced projections;

a rigid movable contact member having spaced first and second movable contacts, a center portion having an actuating surface and being located between the first and second movable contacts, and a pair of integral, laterally spaced arms, wherein the actuating surface of the center portion extends between said arms, said arms are located between the first and second movable contacts and extend from the center portion, said arms having curved end portions swingably supported on free ends of the laterally spaced projections for movement of said first and second movable contacts into and out of respective engagements with said first and second stationary contacts; and an operating knob movably mounted in said opening of said switch casing and including a reciprocatingly mounted, spring-biased pusher, said pusher having an actuating tip selectively positionable by said knob to apply a spring force over the actuating surface of the center portion of said movable contact member extending between said arms and to produce swinging motion of said movable contact member and associated movements of said first and second movable contacts into and out of respective engagements with said first and second stationary contacts, whereby a rotation axis of said movable contact member is at a height substantially the same as a height of a point of contact between the tip of the said pusher and the actuating surface of the center portion of said movable contact member.

2. A switch device as claimed in claim 1, wherein said actuating surface of the center portion of said movable contact member is sloped to provide a dead point engagement position of said actuating tip with said actuating surface that is in substantial in-line relation with the free ends of said projections.

3. A switch device as claimed in claim 2, wherein the free ends of said laterally spaced projections have cylindrical surfaces conforming to the curved end portions of said arms.

* * * * *